US009080226B2

(12) United States Patent
Gillieron et al.

(10) Patent No.: US 9,080,226 B2
(45) Date of Patent: Jul. 14, 2015

(54) COPPER-BASED ALLOY

(75) Inventors: Stephane Gillieron, Tavannes (CH); Hung-Quoc Tran, Bienne (CH); Emmanuel Vincent, St. Imier (CH)

(73) Assignee: SWISSMETAL UMS USINES METALLURGIQUES SUISSE SA, Reconvillier (CH)

( * ) Notice: Subject to any disclaimer, the term of this patent is extended or adjusted under 35 U.S.C. 154(b) by 1703 days.

(21) Appl. No.: 11/230,914

(22) Filed: Sep. 20, 2005

(65) Prior Publication Data

US 2006/0065336 A1 Mar. 30, 2006

Related U.S. Application Data

(63) Continuation of application No. PCT/CH2004/000051, filed on Jan. 30, 2004.

(30) Foreign Application Priority Data

Mar. 21, 2003 (CH) ..... 0496/03

(51) Int. Cl.

| | |
|---|---|
| ***C22C 30/06*** | (2006.01) |
| ***C22C 9/04*** | (2006.01) |
| ***C22F 1/08*** | (2006.01) |

(52) U.S. Cl.

CPC .... *C22C 9/04* (2013.01); *C22F 1/08* (2013.01)

(58) Field of Classification Search

USPC ..... 148/553, 554, 679, 680, 681, 684, 685
IPC ..... C22C 30/06,9/04; C22F 1/08
See application file for complete search history.

(56) References Cited

U.S. PATENT DOCUMENTS

| | | | |
|---|---|---|---|
| 4,410,290 | A | 10/1983 | Ito et al. |
| 4,631,171 | A | 12/1986 | McDonald et al. |
| 6,485,846 | B1 | 11/2002 | Zheleznyakov et al. |

FOREIGN PATENT DOCUMENTS

| | | | |
|---|---|---|---|
| CH | 508 049 | | 5/1971 |
| DE | 2051 566 | | 4/1972 |
| DE | 292 933 | A | 8/1991 |
| FR | 2 008 021 | | 1/1970 |
| FR | 2394619 | A * | 2/1979 |
| GB | 1188277 | | 3/1969 |
| JP | 01177327 | | 7/1989 |
| JP | 07166279 | | 6/1995 |
| JP | 09087793 | | 3/1997 |

OTHER PUBLICATIONS

Miodownik, A.P., Cu (Copper) Binary Alloy Phase Diagrams, Alloy Phase Diagrams, vol. 3, ASM Handbook, ASM International, 1992, p. 2.167-2.182 (only Cu—Zn phase diagram and crystallographic data are provided).*

D.M. Ward and B.J. Helliwell, "The Effect of Structure and Composition on the Workability of Leaded Cu—Ni—Zn—Mn Alloys" Institute of Metals, London, GB, Monograph and Report Series No. 34, p. 155-159, 1970.

* cited by examiner

*Primary Examiner* — Sikyin Ip
(74) *Attorney, Agent, or Firm* — Pearne & Gordon LLP

(57) ABSTRACT

Alloy on the basis of copper, zinc, nickel, lead and manganese having properties of resistance to corrosion, notably to inks and gel-inks. The inventive alloy can have a mono-phased alpha structure and a bi-phased alpha-beta structure and is especially suited to the production of tips and reservoirs for writing implements.

4 Claims, 7 Drawing Sheets

COPPER-BASED ALLOY

REFERENCE DATA

This application is a continuation of International Patent Application 2004WO-CH00051 (WO04/083471) filed on Jan. 30, 2004, claiming priority of Swiss patent application 2003CH-0496 filed on Mar. 21, 2003 and granted under CH693948, the contents whereof are hereby incorporated.

FIELD OF THE INVENTION

The present invention concerns a copper-based alloy and its applications and more precisely a copper-nickel-zinc alloy intended for use in the manufacture of ballpoint pen components.

DESCRIPTION OF RELATED ART

It is known to use copper-based alloys of different composition to form tubular ink guides, ink reservoirs and tips of writing implements. Certain known alloys however have the inconvenience of being incompatible with the low-viscosity inks used in new generation ballpoint pens.

The incompatibility between the alloy and the ink can then reduce the implement's functional efficiency and comfort of writing. The ink leaks that may result cause the quality of the writing to deteriorate and, in the worst cases, stains and smears.

The resistance to gel-inks can be improved by increasing the alloy's copper content, as for example in alpha brass and in alpha copper-nickel-zinc alloys. This solution has however the inconvenience of reducing the alloy's heat-deformability. The poor heat-deformability of the prior art alloys implies higher production costs.

Another limitation of brass is that its yellow coloration is not appreciated by all consumers.

It is thus an aim of the present invention to propose an alloy and ballpoint pen components free from the limitations of the prior art.

BRIEF SUMMARY OF THE INVENTION

According to the invention, these aims are achieved by the alloys, the devices and the methods that are the object of the claims of the corresponding categories, and for example by an alloy including:

between 44.1 and 45.6 parts by weight of Cu;
between 35.6 and 37.1 parts by weight of Zn;
between 11.8 and 12.7 parts by weight of Ni;
between 4.6 and 5.4 parts by weight of Mn.

BRIEF DESCRIPTION OF THE DRAWINGS

The present invention will be better understood by reading the attached claims and the description given by way of example and illustrated by the attached figures, in which:

DETAILED DESCRIPTION OF POSSIBLE EMBODIMENTS OF THE INVENTION

According to one aspect of the invention, the inventive alloy is a copper-nickel-zinc alloy of white, gray or silver color, having the following composition:

TABLE 1

| | % weight | |
|---|---|---|
| | min | max |
| Cu | 43.00 | 48.00 |
| Zn | 33.00 | 38.00 |
| Ni | 10.00 | 15.00 |
| Mn | 3.50 | 6.50 |
| Pb | 0.00 | 4.00 |

Figure 1:
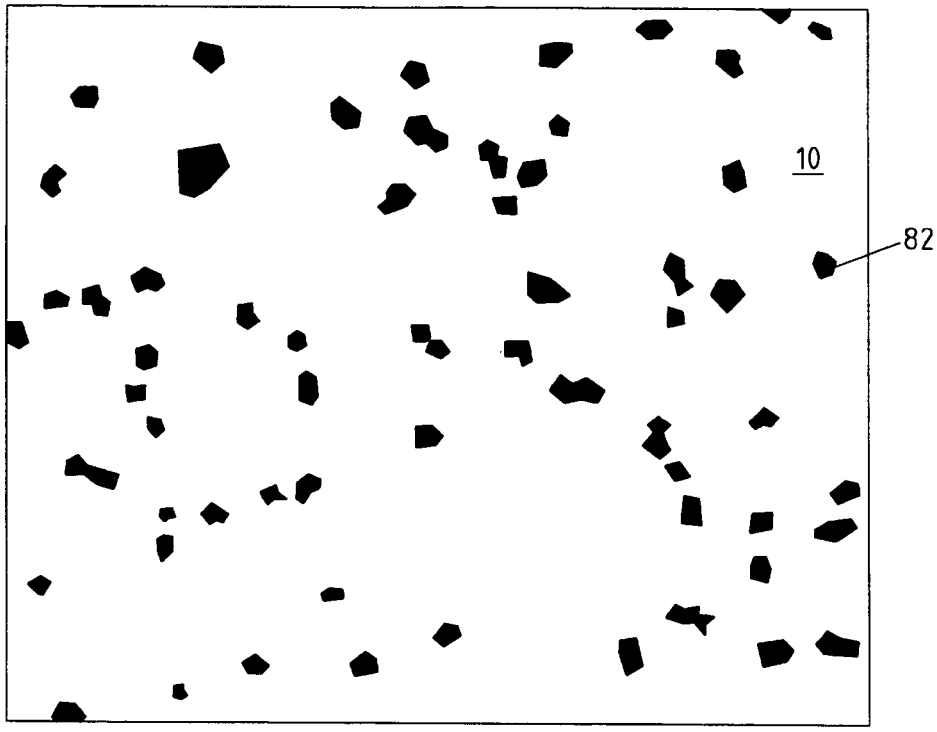
FIG. 1 represents a metallographic section of an alloy according to the invention in a mono-phased alpha structure.
Figure 1A:
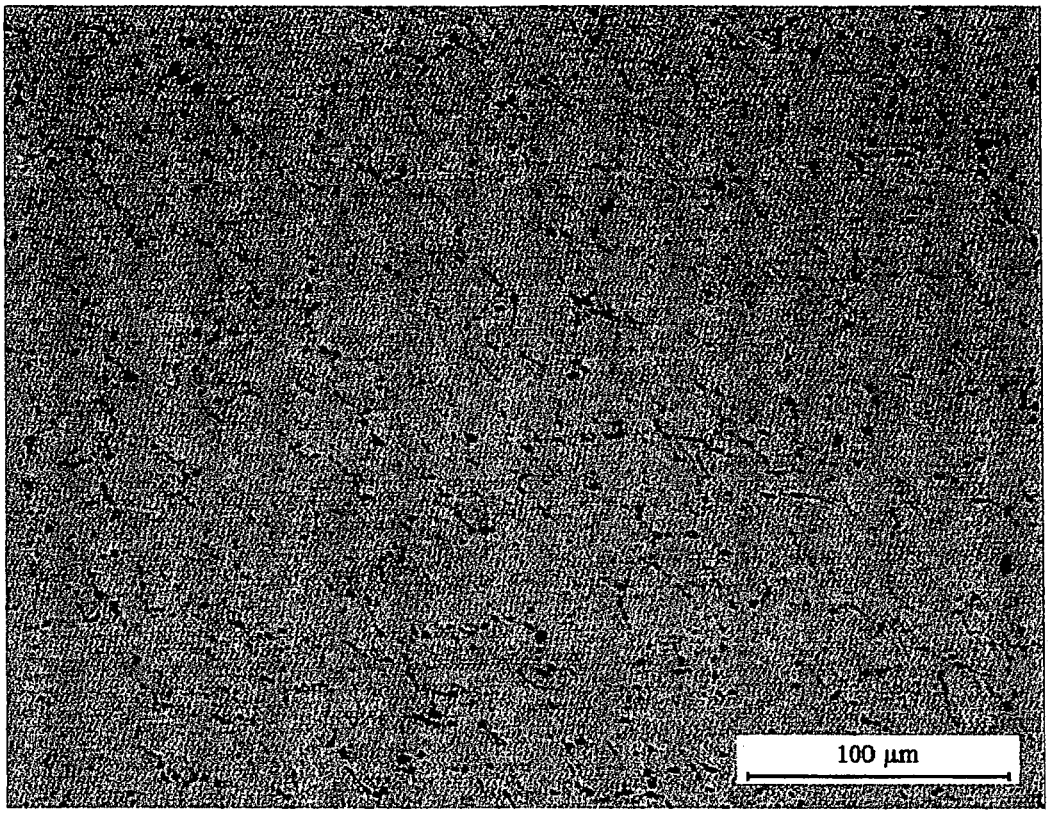
FIG. 1*a* represents a micrograph corresponding to FIG. 1.

This alloy has the characteristic of having two types of microstructures that can be controlled by hot treatment. The first, i.e. the mono-phased alpha structure, is essentially composed of a single crystalline phase of uniform structure. FIG. 1 represents a microphotography of a metallographic section of the alloy according to the invention, showing the alpha structure. It will be observed that the alloy is composed essentially of a uniform solid solution of its components 10, apart from the black lead particles 82.

Figure 2:
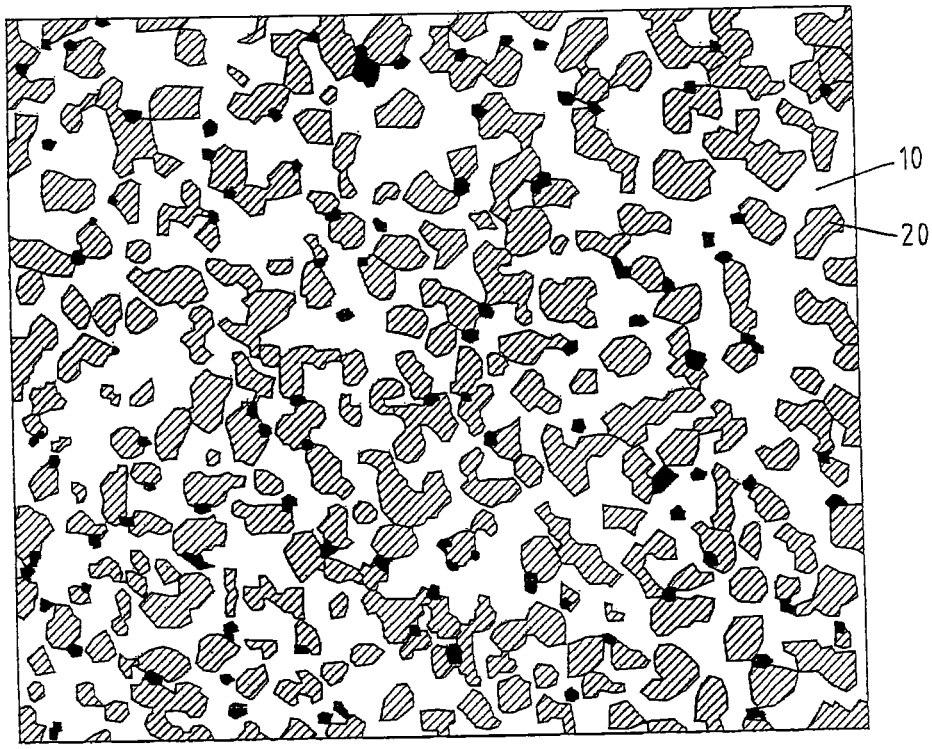
Fig. 2 PRIOR ART
FIG. 2 represents a metallographic section of a prior art copper-nickel-zinc alloy in a bi-phased alpha-beta structure.
Figure 2A:
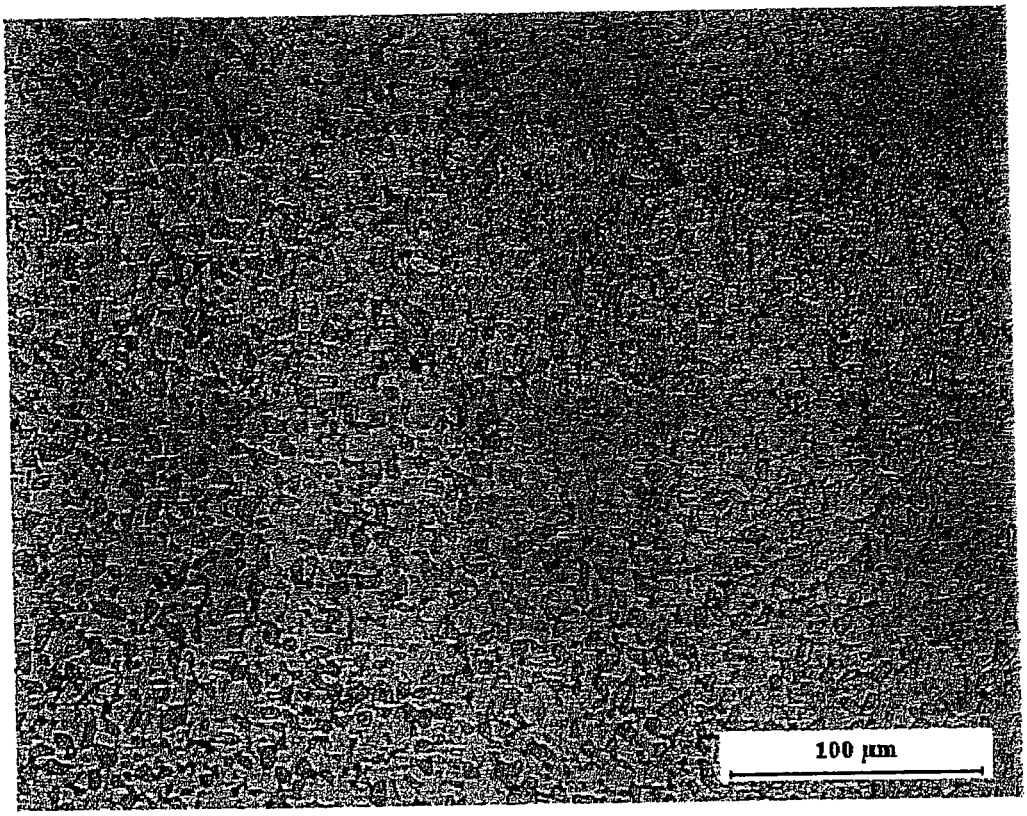
Fig. 2a PRIOR ART
FIG. 2*a* represents a micrograph corresponding to FIG. 2.

The inventive alloy can also have the bi-phased alpha-beta structure. This structure, represented in FIG. 2, has grains of a second phase 20, i.e. the beta phase, having a lower copper content than that of the alpha phase and which can be distinguished in FIG. 2 by their darker color.

The different structures of the inventive alloy are adapted to specific forming and machining processes. In particular, the bi-phased alpha-beta structure is favorable to heat-deformation, whilst the mono-phased alpha structure is favorable to cold-deformation.

The adjunction of lead in the alloy makes the machining operations easier, for example slicing. It would however also be possible to omit the lead, or to reduce its content, if this property is not required.

The inventive alloy can thus appear in both the mono-phased alpha structure and the bi-phased alpha-beta structure. It is however possible to control the structure by a hot treatment between 570° C. and 780° C. during 1-3 hours, followed by a fast cooling to ambient temperature. Following this treatment, the alloy's structure is essentially alpha.

The invention also includes alloys to which, besides the elements having the nature and proportions as defined by the table 1 here above, are added low quantities of other elements, metallic or not, such as magnesium (Mg), aluminum (Al), iron (Fe), phosphorus (P) or any other chemical element or species.

In a second example of alloy according to the invention, the alloy's composition is determined, except for unavoidable impurities, by the table 2 here after:

TABLE 2

| | % weight | |
|---|---|---|
| | min | max |
| Cu | 44.10 | 45.60 |
| Zn | 35.60 | 37.10 |
| Ni | 11.80 | 12.70 |
| Mn | 4.60 | 5.40 |
| Pb | 1.35 | 1.85 |

Figure 4:
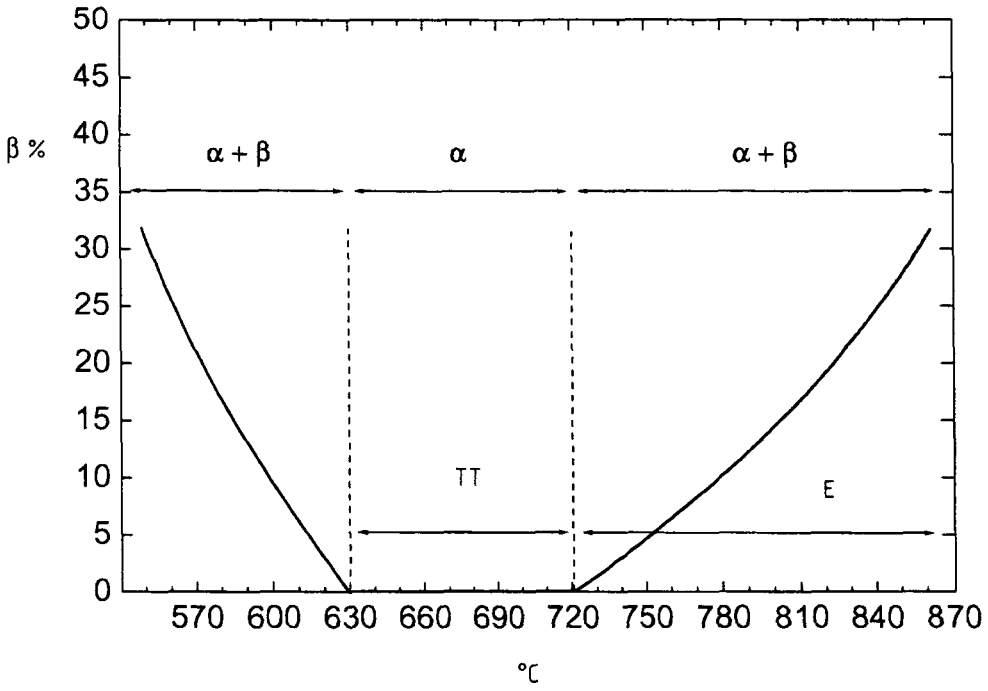
FIG. 4 represents a diagram of a beta phase ratio of an alloy according to the invention according to the hot treatment temperature.

FIG. 4 represents the beta phase ratio according to the hot treatment temperature. The choice of the temperature of the hot treatment allows the ratio of the beta phase to be modified and, consequently, to obtain materials having different properties. In particular, hot treatment in the TT temperature range at temperatures included between 630° C. and 720° C. gives rise to a mono-phased alpha structure. The temperature range E is favorable to extrusion.

The diagram of FIG. 4 is specific to the alloy composition specified in table 2. According to another aspect of the invention, it would also be possible to adopt different proportions of Cu, Zn, Ni, Mn and Pb and obtain an alloy whose ratios of alpha and beta phases can be modified by hot treatment. In particular, the proportion of each of the alloy's components can be varied independently within the value range indicated in table 1 or beyond. The temperatures required for modifying the structure of the obtained alloy will then be different.

Figure 3:
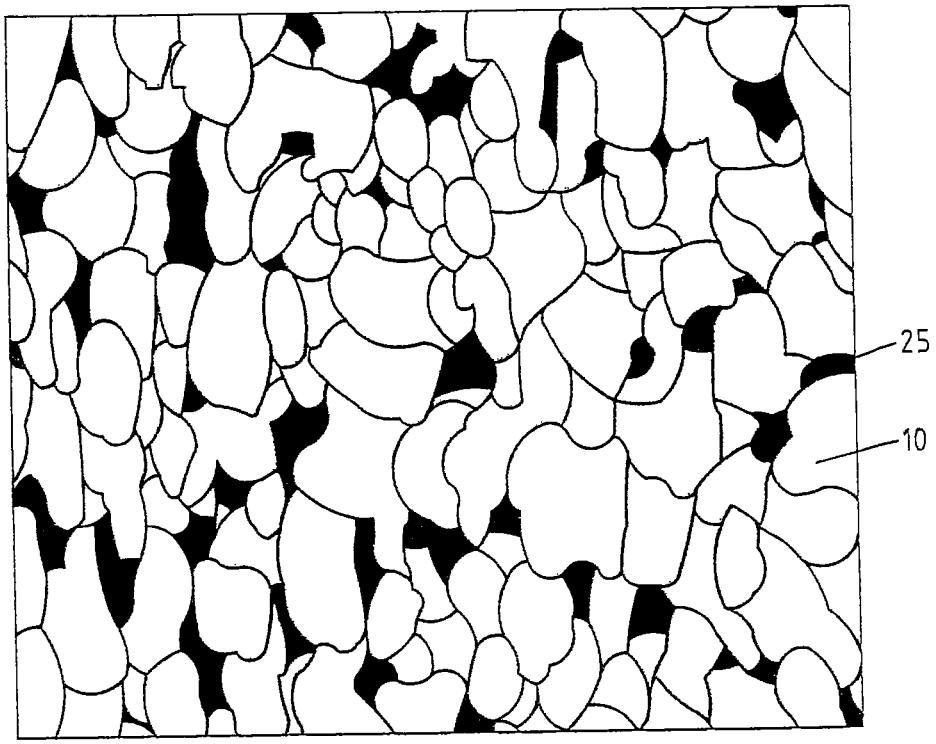
Fig. 3 PRIOR ART
FIG. 3 represents a metallographic section of a prior art bi-phased copper-nickel-zinc alloy corroded following exposition to ink.
Figure 3A:
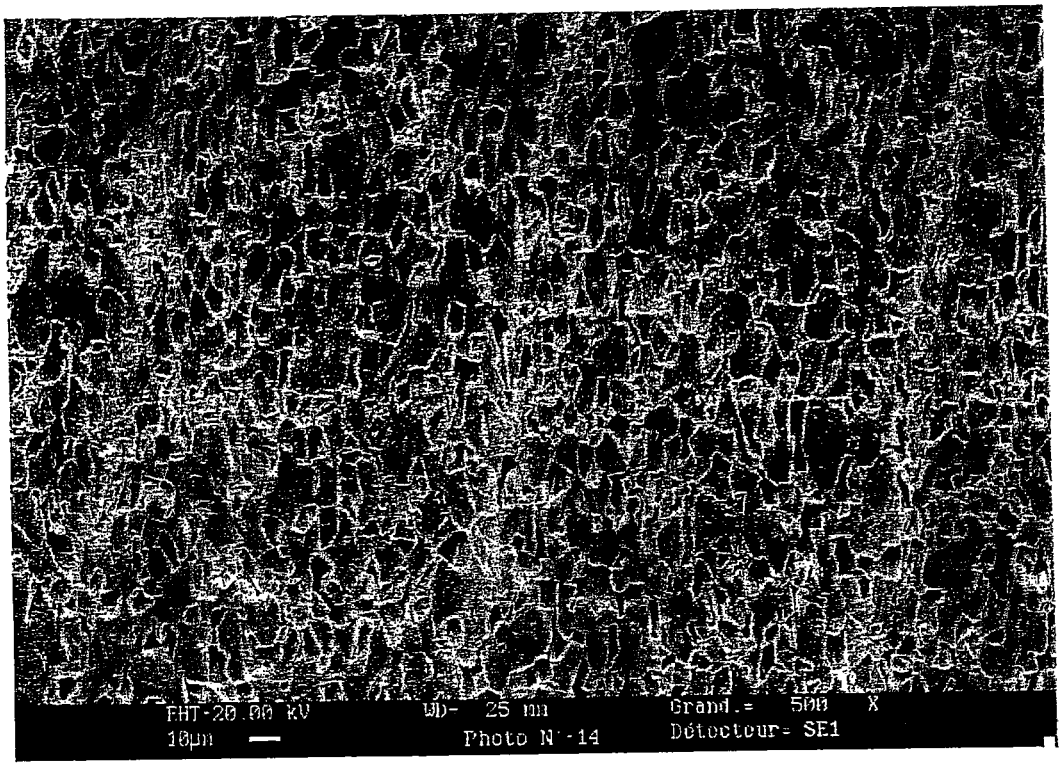
Fig. 3a PRIOR ART
FIG. 3*a* represents a micrograph corresponding to FIG. 3.

The inventive alloy has increased resistance to corrosion due to gel-inks when it is in the mono-phased alpha structure. The beta phase is in fact the only one that is dissolved by gel-inks. FIG. 3 represents a metallographic section of an alpha-beta copper-nickel-zinc alloy corroded by the chemical reaction with the ink. It can be observed that only the beta phase is attacked and that its dissolution leaves cavities 25.

Although the alloy of the invention described here above is particularly suited to making tips of writing implements, and in particular of ballpoint pens, the present invention is not limited to this specific use but also includes any other use of the inventive alloy.

According to another aspect of the invention, the alloy having the composition here above is first cast in small rods or bars or in any other shape adapted to heat-deformation.

Contrary to alpha copper-nickel-zinc alloys, the inventive alloy offers excellent deformability at high temperature. All the usual heat-deformation processes are possible. Typically, the small rods are heat-extruded at a temperature included between 720° C. and 870° C., a temperature at which its structure is bi-phased alpha-beta. The wires thus obtained are then hot treated between 630° C. and 720° C., as explained here above, to obtain the mono-phased alpha structure.

As the mono-phased alpha structure is suited to cold deformation, the extruded material is then drawn to obtain bars or wires of suitable diameter to form the tubes of ink guides, ink reservoirs or tips for writing implements.

The material thus obtained can easily be shaped by cold-working and machining, for example by embossing, machining, crimping, lathe turning, milling or any other process.

The mechanical characteristics of the inventive alloy treated as described here above depend on its level of cold working according to the following table:

TABLE 3

| State | Mechanical resistance [MPa] | Breaking elongation [%] |
|---|---|---|
| After hot treatment | 450-600 | 25-50 |
| 20% reduction rate After hot treatment | 600-800 | 10-30 |
| 40% reduction rate After hot treatment | 800-1100 | 1-20 |

The mechanical resistance and breaking elongation in the above table have been determined according to the standardized method EN10002-1.

The invention claimed is:

1. A method of preparing a mono-phased alpha structure alloy from a bi-phased alpha-beta structure alloy, comprising the steps of providing an initial bi-phased alpha-beta structure alloy consisting of:

Between 44.1 and 45.6 parts by weight of Cu;

between 35.6 and 37.1 parts by weight of Zn;

between 11.8 and 12.7 parts by weight of Ni;

between 4.6 and 5.4 parts by weight of Mn;

between 1.35 and 1.85 parts by weight of Pb; and hot treating said initial bi-phased alpha-beta structure alloy one or several times at a temperature between 630° C. and 720° C. to transform the bi-phased alpha-beta structure of said initial bi-phased alpha-beta structure alloy into a mono-phased alpha structure.

2. The method of claim 1, also including: a step of casting the melted alloy; possibly one or several steps of heat-deformation; one or several steps of cold-deformation.

3. The method of claim 2, wherein the temperature of said heat deformation is included between 720° C. and 870° C.

4. A method of preparing a mono-phased alpha structure alloy from a bi-phased alpha-beta structure alloy, comprising the steps of:

Providing an initial bi-phased alpha-beta structure alloy consisting of:

between 44.1 and 45.6 parts of weight of Cu;

between 35.6 and 37.1 parts of weight by Zn;

between 11.8 and 12.7 parts by weight of Ni;

between 4.6 and 5.4 parts of weight of Mn; and between 1.35 and 1.85 parts by weight of Pb;

heat deforming the alloy in one or several steps in the bi-phased alpha-beta structure $\alpha/\beta$; and hot treating said initial bi-phased alpha-beta structure alloy one or several times at a temperature between 630° C. and 720° C. to transform the bi-phased alpha-beta structure of said initial bi-phased alpha-beta structure alloy into a mono-phased alpha structure.

* * * * *